US005911683A

United States Patent [19]

Cui et al.

[11] Patent Number: 5,911,683

[45] Date of Patent: Jun. 15, 1999

[54] EXHAUST-GAS COLLECTING AND CLEANING DEVICE AS WELL AS EXHAUST-GAS DEVICE FOR A MULTI-CYLINDER ENGINE

[75] Inventors: Hongjiang Cui, Meitingen; Rudolf Gallitscher, Schorndorf, both of Germany

[73] Assignee: Zeuna-Starker GmbH & Co. KG, Augsburg, Germany

[21] Appl. No.: 09/054,079

[22] Filed: Apr. 2, 1998

[51] Int. Cl.[6] ..... F01N 3/10; F01N 7/10

[52] U.S. Cl. ..... 60/302; 60/323

[58] Field of Search ..... 60/302, 323; 29/890

[56] References Cited

U.S. PATENT DOCUMENTS

| | | | |
|---|---|---|---|
| 4,018,047 | 4/1977 | Kimura et al. | 60/323 X |
| 5,410,877 | 5/1995 | Shimada et al. | 60/323 X |

FOREIGN PATENT DOCUMENTS

| | | | |
|---|---|---|---|
| 587474 | 3/1994 | European Pat. Off. | 60/323 |
| 57-203814 | 12/1982 | Japan | 60/302 |

*Primary Examiner*—John E. Ryznic

*Attorney, Agent, or Firm*—Helfgott & Karas, PC.

[57] ABSTRACT

An exhaust gas collecting and cleaning device for a multi-cylinder engine comprising an exhaust-gas manifold (1) constructed as a casting and an exhaust-gas cleaning device (5) mounted near the engine, attached to the exhaust-gas manifold (1) and comprising a housing (6) and at least one exhaust-gas cleaning element (14) bedded therein. A tubular section (12), which is constructed as a sheet-metal part and projects from the casting, is cast into the exhaust-gas manifold (1) at the outlet end region thereof. To this there is joined a downstream segment of the housing (6) of the exhaust-gas cleaning device (5). According to an independent embodiment, a downstream exhaust-gas guide element (such as a corrugated pipe) instead of the exhaust-gas cleaning device is joined in corresponding manner to the exhaust-gas manifold constructed as a casting.

7 Claims, 4 Drawing Sheets

EXHAUST-GAS COLLECTING AND CLEANING DEVICE AS WELL AS EXHAUST-GAS DEVICE FOR A MULTI-CYLINDER ENGINE

BACKGROUND OF THE INVENTION

The present invention relates to an exhaust-gas collecting and cleaning device for a multi-cylinder engine, comprising an exhaust-gas manifold constructed as a casting and an exhaust-gas cleaning device mounted near the engine, attached to the exhaust-gas manifold and comprising a housing and at least one exhaust-gas cleaning element bedded therein. According to an independent further aspect, it relates to an exhaust-gas device for a multi-cylinder engine, comprising an exhaust-gas manifold constructed as a casting and an exhaust-gas guide element mounted near the engine and attached to the exhaust-gas manifold.

An exhaust-gas collecting and cleaning device according to the introduction is known from European Patent Application 0761939. The purpose of mounting the exhaust-gas cleaning device close to the engine is to favor its heat-up behavior, or in other words to shorten the time needed for effective exhaust-gas cleaning to develop after the engine is started. In the known exhaust-gas collecting and cleaning device according to the introduction, the exhaust-gas manifold and the inlet funnel as well as the jacket of the housing of the exhaust-gas cleaning device form a structural unit, in that they are constructed as a one-piece casting. An outlet funnel constructed as a sheet-metal part is welded onto the jacket of the housing of the exhaust-gas cleaning device.

The known exhaust-gas collecting and cleaning device of the type according to the introduction suffers from a large number of considerable disadvantages: In particular, the combined casting for exhaust-gas manifold and inlet funnel as well as jacket of the housing of the exhaust-gas cleaning device is complex and therefore expensive to make. The heavy weight or large mass of each cast unit is also a disadvantage, not the least with respect to the heat-up behavior of the exhaust-gas cleaning device. Furthermore, a welded joint is provided between the jacket of the housing of the exhaust-gas cleaning device constructed as a casting and the outlet funnel constructed as a sheet-metal part; such a welded joint is also complex and expensive because of the unavoidable requirements (especially choice of specific material and preheating of the casting, use of a specific welding wire).

From the disadvantages associated with the prior art, the present invention derives its basic object which consists in further developing an exhaust-gas collecting and cleaning device of the type according to the introduction to the effect that simple and inexpensive manufacture is possible in combination with light weight.

SUMMARY OF THE INVENTION

This object is achieved according to the present invention by the fact that a tubular section, which is constructed as a sheet-metal part and projects from the casting, and to which a downstream segment of the housing of the exhaust-gas cleaning device is joined, is cast into the exhaust-gas manifold at the outlet end region thereof. In other words, the exhaust-gas collecting and cleaning device according to the invention is characterized by the fact that, during casting of the exhaust-gas manifold, there is cast into the outlet end region thereof a tubular section, which is constructed as a sheet-metal part and projects from the exhaust-gas manifold on the outlet end thereof, in order to permit a joint to a downstream segment of the housing of the exhaust-gas cleaning device. In this sense, the "downstream segment" of the housing of the exhaust-gas cleaning device can in particular be an inlet funnel or else an approximately cylindrical jacket of the housing.

The advantages of the present invention are extremely numerous. For example, the component weight is lighter than in the prior art according to the introduction, and the reduced component mass leads to further shortening of the heat-up phase of the exhaust-gas cleaning device. Furthermore, in contrast to the prior art according to the introduction, the manifold material does not have to be suitable for welding. In using the invention, however, the proven design of the exhaust-gas manifold as a casting can be retained without the need for a complex and/or expensive joint to the downstream exhaust-gas cleaning device. In particular, a flange is not needed either at the outlet end of the exhaust-gas manifold or at the inlet end of the exhaust-gas cleaning device, and so the manufacturing costs associated with machining flanges are not incurred. Likewise, there is no need for the bolted coupling of the two flanges, which is required in the case of a flanged joint and can lead to leaks during operation, and which necessitates a component design providing accessibility to the bolted coupling. In addition, the assembly complexity is much less than in the case of a bolted coupling. The geometry of the transition point and from the exhaust-gas manifold to the exhaust-gas cleaning device and of the transition region defined by the inlet funnel can be chosen with great flexibility. And, finally, the concept reduced to practice by the present invention is particularly suitable for inexpensive modular construction, in which case the small number of components also has a positive effect on the function of the exhaust gas collecting and cleaning device.

The tubular section cast into the outlet end of the exhaust-gas manifold in the scope of the present invention can be constructed in several ways. In addition to a design comprising a drawn part, a structure comprising two hemispheres is possible in particular, in which case single-layer and multiple-layer constructions are equally suitable. The cross-sectional shape can be round, oval, spectacle-shaped (especially for multi-stream structure of the exhaust-gas system) or similar. The tubular section does not necessarily have constant cross section; instead it can taper, flare or otherwise change its cross section in its longitudinal direction.

A first preferred further embodiment of the invention is characterized in that the tubular section cast into the exhaust-gas manifold is constructed as the inlet funnel of the housing of the exhaust-gas cleaning device. The tubular section can be shaped as the inlet funnel of the housing of the exhaust-gas cleaning device both before and after manufacture of the cast manifold, the process of internal high-pressure forming being particularly suitable for shaping the inlet funnel. In the process, this can in particular be constructed as a twin (multiple layer) funnel.

It is by no means required, however, that the tubular section cast into the exhaust-gas manifold be constructed as the inlet funnel of the housing of the exhaust-gas cleaning device as explained hereinabove. Instead, the tubular section can be formed in the same way as the connecting pipe to which the inlet funnel of the housing of the exhaust-gas cleaning device is joined.

Another preferred further embodiment of the invention is characterized in that the tubular section and the downstream segment of the housing of the exhaust-gas cleaning device are joined to each other by means of a weld. In this connection, it proves to be particularly favorable to weld two sheet-metal parts to each other. Consequently, it is not necessary either to preheat any component or to use special welding wire. Furthermore, the problems of fatigue strength of the weld, usually encountered in welding castings and metal sheets, are ruled out with certainty. Furthermore, the welded joint between the tubular section and the downstream segment of the housing of the exhaust-gas cleaning device can be designed optimally with respect to material, geometry and process operation.

The present invention can be adapted for attaching other components of an exhaust-gas system to the exhaust-gas manifold constructed as a cast manifold. For example, a coupling element (such as a corrugated pipe or bellows) to compensate for expansion can be attached in corresponding manner to the exhaust-gas manifold. Such use of the ideas of the invention for exhaust-gas systems of the type in which a component (exhaust-gas guide element) other than an exhaust-gas cleaning device is attached to the exhaust-gas manifold is the subject matter of coordinated claim 7.

BRIEF DESCRIPTION OF THE DRAWINGS

The invention will be explained in more detail hereinafter with reference to three preferred practical examples illustrated in the drawing, wherein.

DETAILED DESCRIPTION OF THE INVENTION

Figure 1:
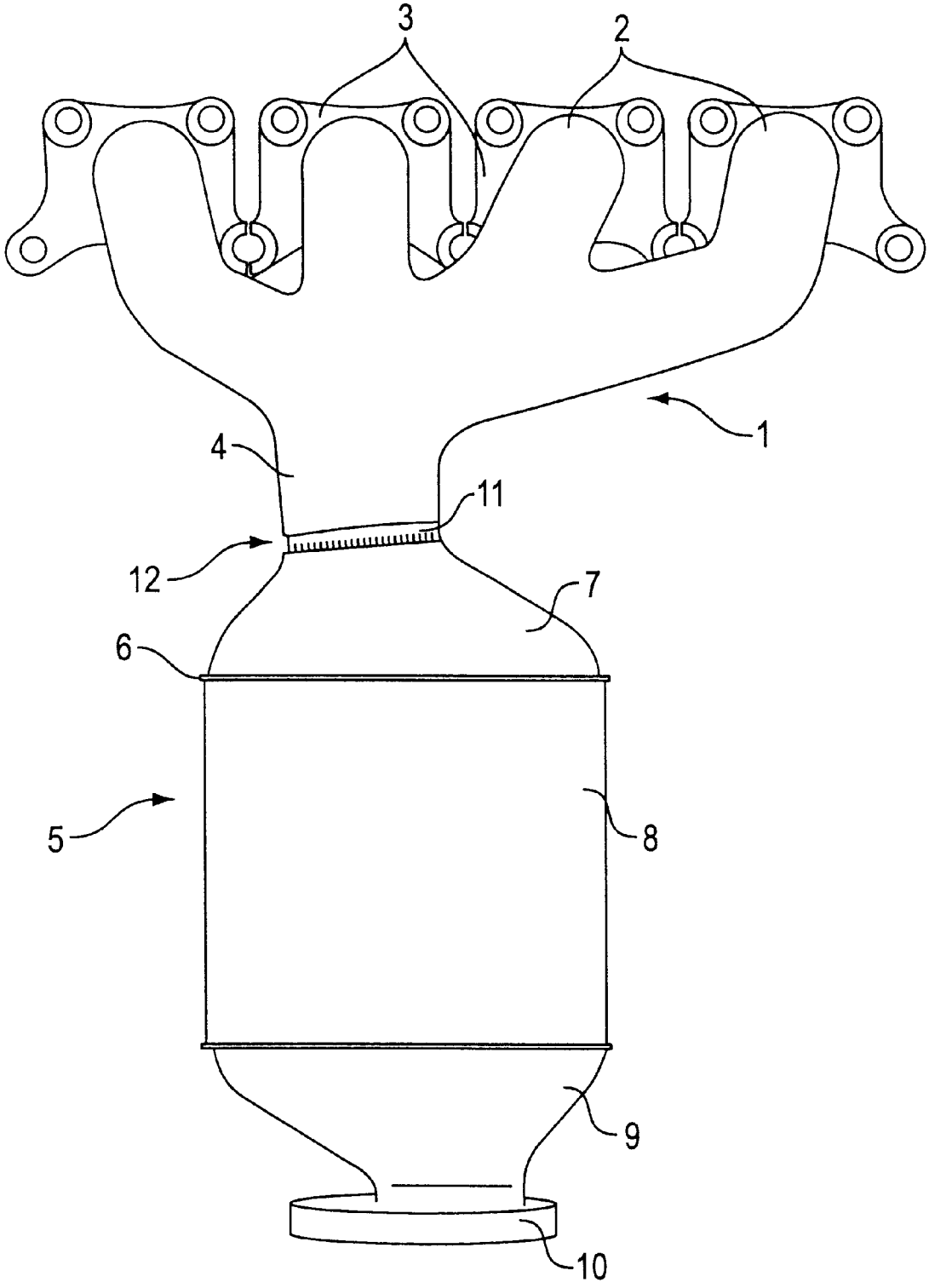
FIG. 1 shows a view of a first embodiment of the exhaust-gas collecting and cleaning device according to the invention.
Figure 2:
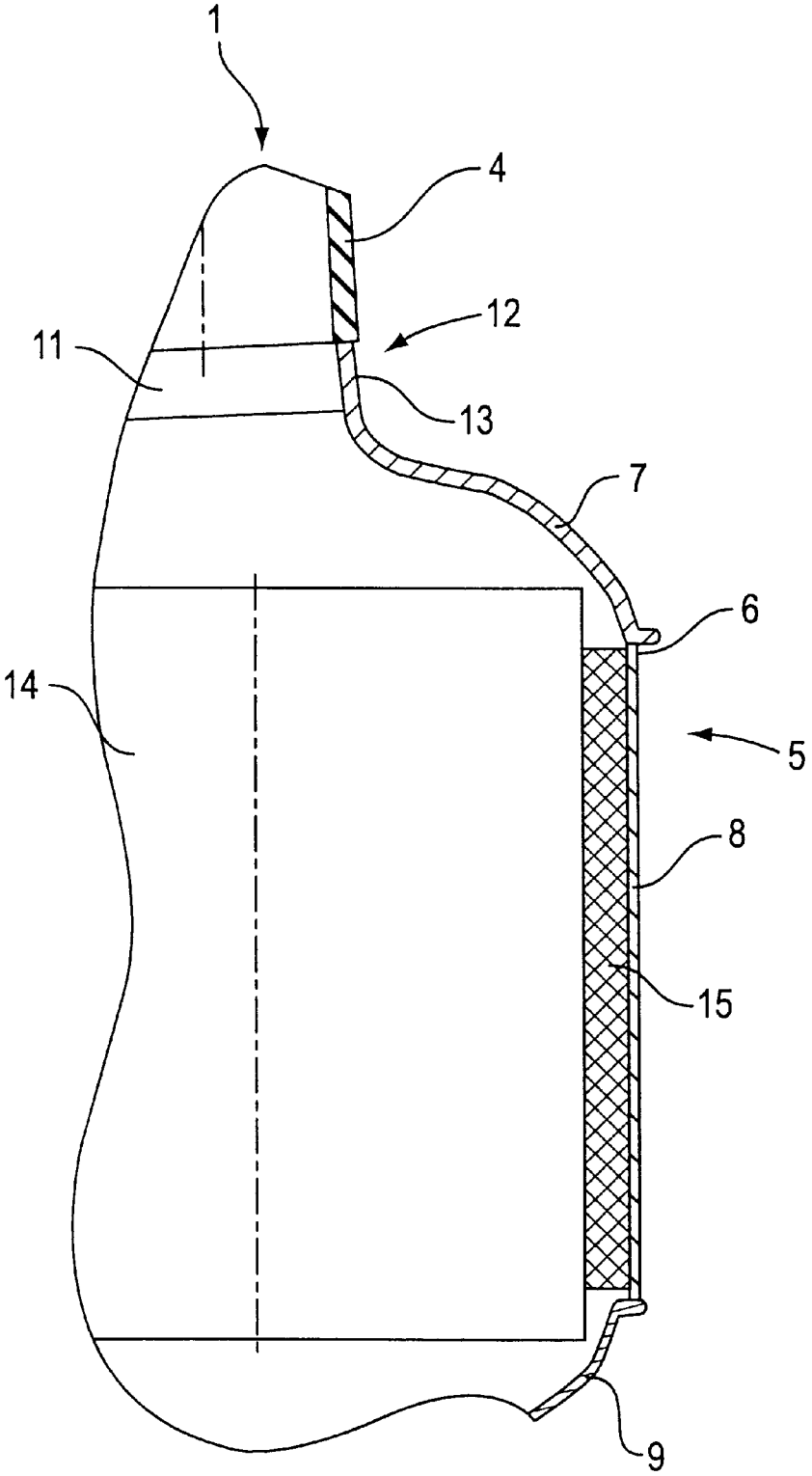
FIG. 2 shows a partial section through the exhaust-gas collecting and cleaning device according to FIG. 1.

The exhaust-gas collecting and cleaning device illustrated in FIGS. 1 and 2 is designed for attachment to a 4-cylinder straight-type engine. Accordingly, the exhaust-gas manifold 1 constructed as a casting comprises four inlets 2. The inlets 2 each end in a flange 3 provided on the engine side for connection to the cylinder head. The exhaust-gas manifold 1 collects the exhaust gas of all four cylinders; accordingly it comprises a common outlet 4.

Immediately downstream from exhaust-gas manifold 1 there is connected an exhaust-gas cleaning device 5. Its housing 6 is constructed of three segments, namely an inlet funnel 7, a cylindrical jacket 8 and an outlet funnel 9. The three segments of the housing of exhaust-gas cleaning device 5 are joined to each other by means of two welds, in a manner known in itself. In addition, an outlet flange 10 is welded to outlet funnel 9.

To join exhaust-gas cleaning device 5 to exhaust-gas manifold 1, a tubular section 12 constructed as connecting pipe 11 is cast into the end region of outlet 4 of exhaust-gas manifold 1. Tubular section 11, which projects a few centimeters out of the casting, comprises easily weldable sheet metal. Its wall thickness is substantially the same as the wall thickness of inlet funnel 7. Connecting pipe 11 projects slightly into the end section of inlet funnel 7. The two parts are joined to each other by a circumferential weld 13.

FIG. 2 schematically illustrates, for completeness, how an exhaust-gas cleaning element 14 is bedded in jacket 8 of the housing of exhaust-gas cleaning device 5 together with an interposed bedding mat 15. Details are not shown, in view of the fact that any known configuration is conceivable here.

Figure 3:
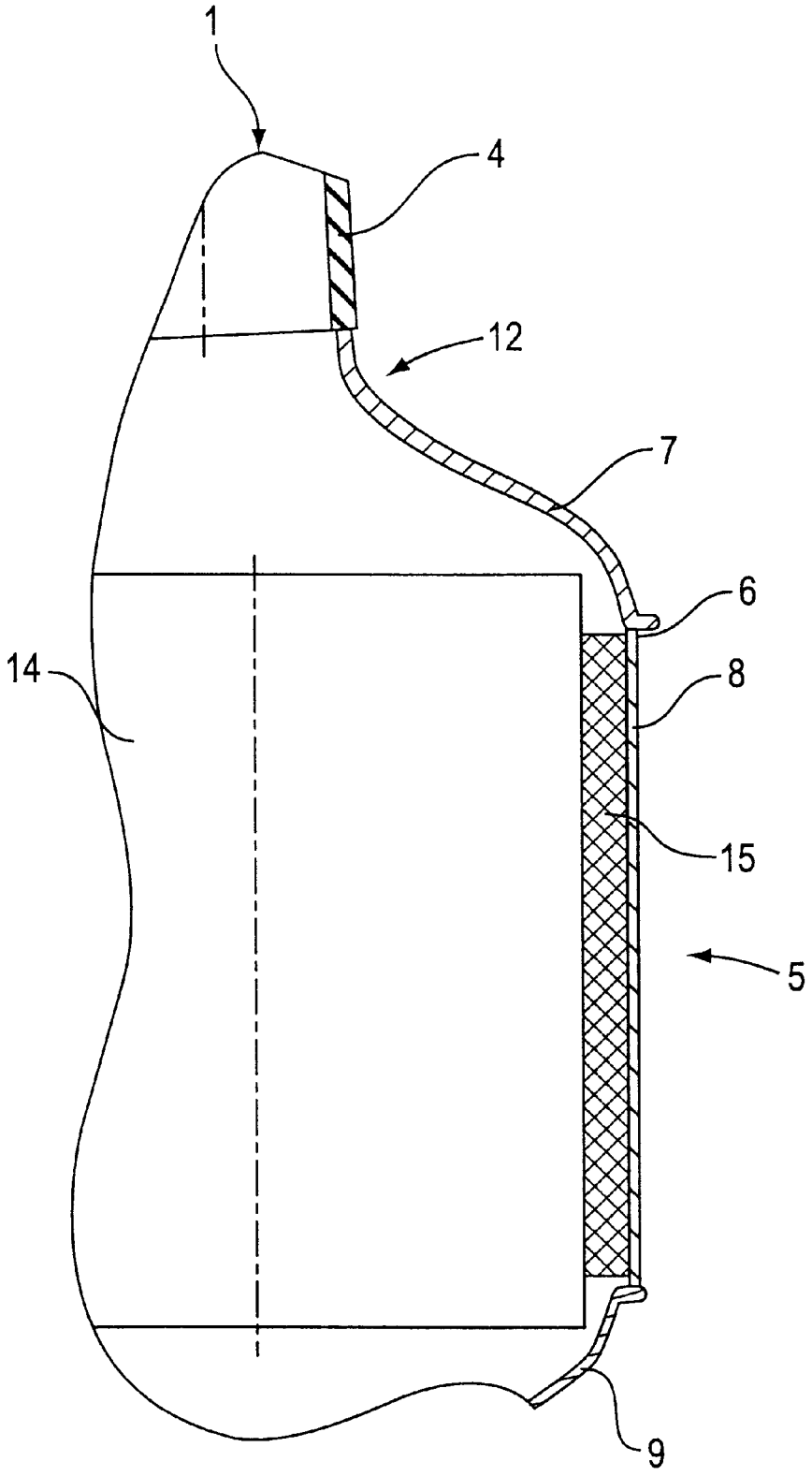
FIG. 3 shows a partial section through a modification of the exhaust-gas collecting and cleaning device illustrated in FIGS. 1 and 2.

The modification illustrated in FIG. 3 differs from the exhaust-gas collecting and cleaning device described hereinabove solely in that the tubular section 12 cast into the end region of outlet 4 of exhaust-gas manifold 1 is itself constructed as inlet funnel 7 of housing 6 of exhaust-gas cleaning device 5. In this way, the number of components and also the number of welds is further reduced by one compared with the embodiment of the invention explained hereinabove.

Figure 4:
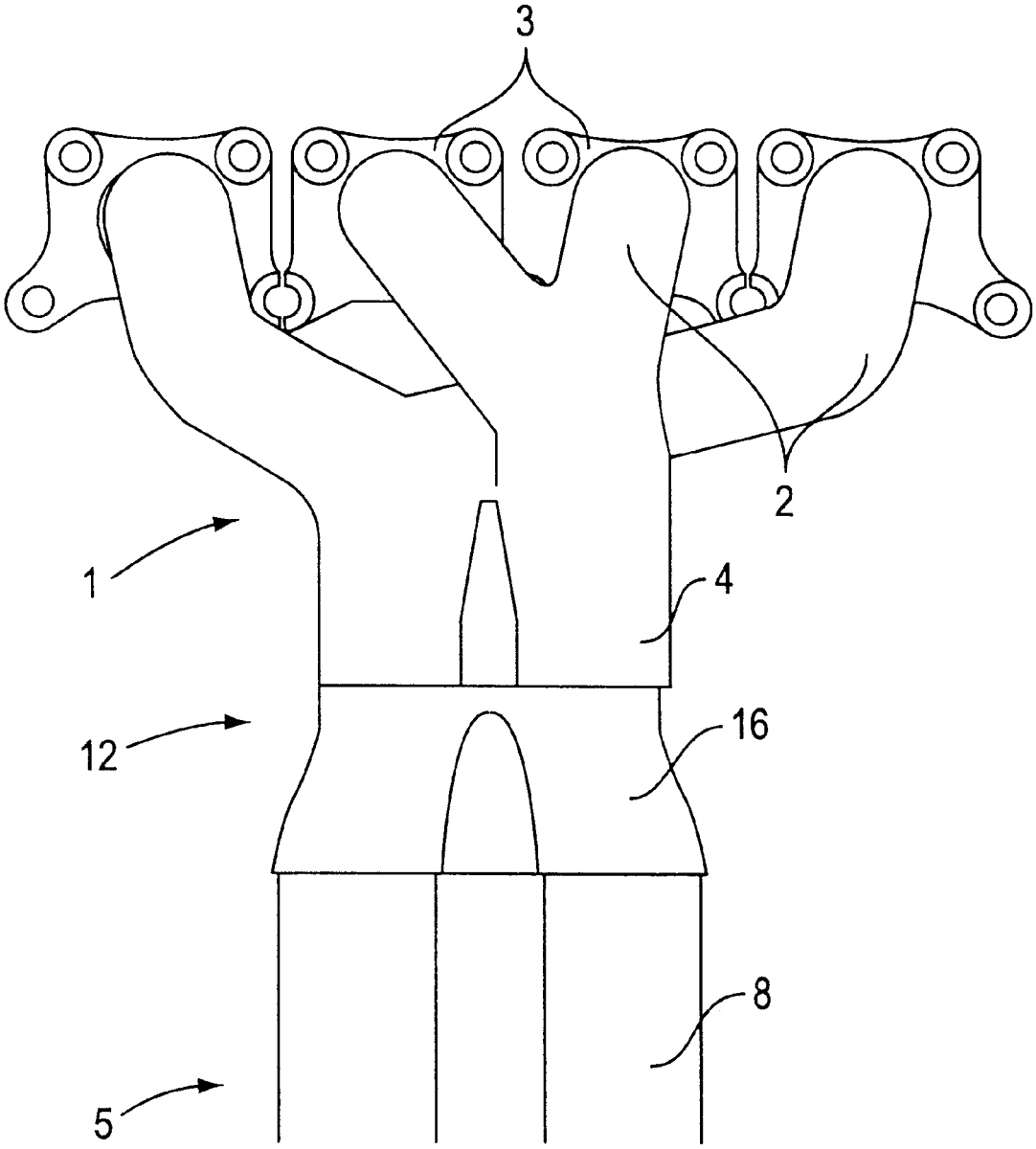
FIG. 4 shows a top view of a further embodiment of the exhaust-gas collecting and cleaning device according to the invention.
Figure 3:
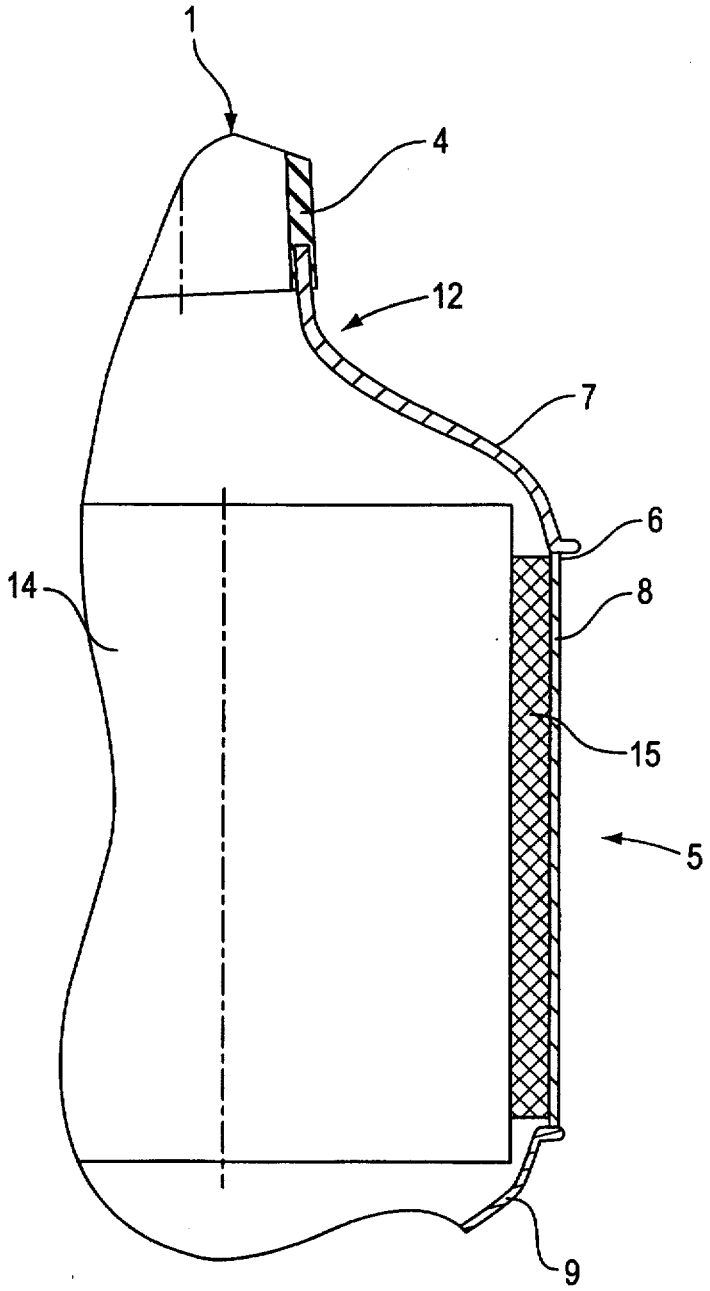
Figure 2:
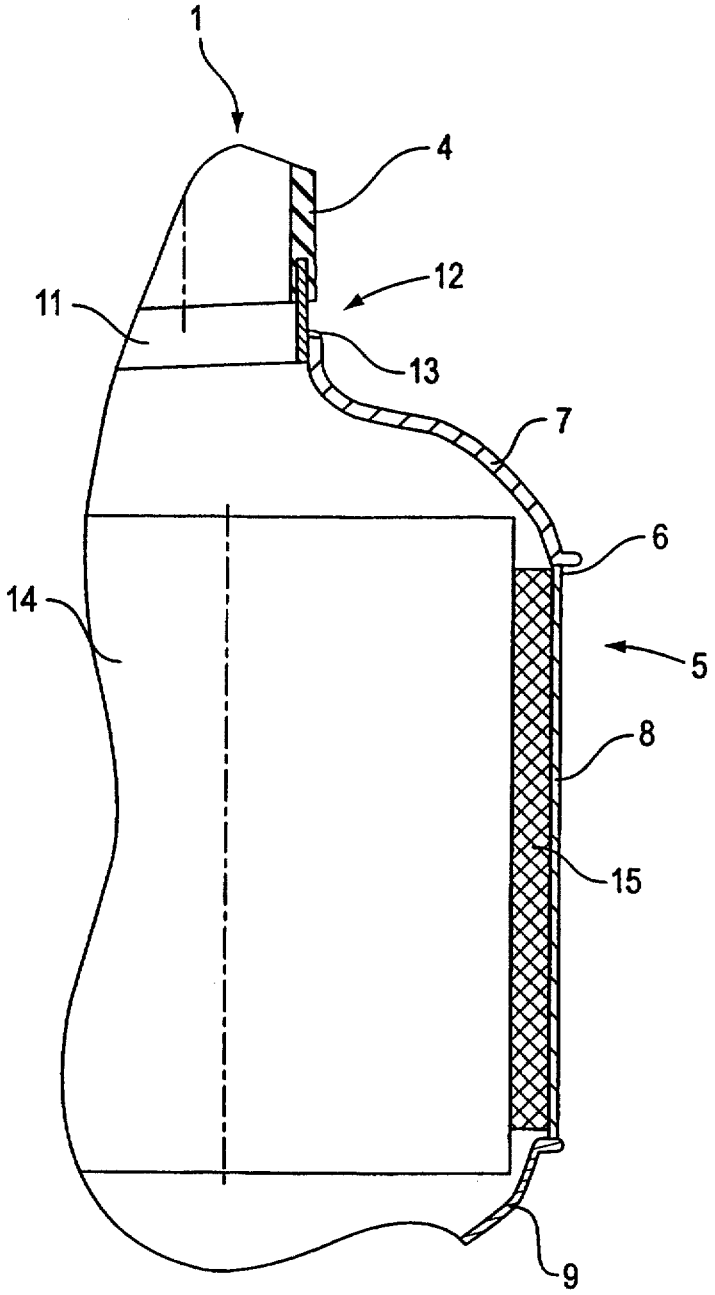

FIG. 4 illustrates the fact that the present invention is in no way limited to exhaust-gas manifolds of the type that collect the exhaust-gas of all cylinders in a single exhaust-gas stream. For example, in the exhaust-gas collecting and cleaning device illustrated in FIG. 4, exhaust-gas cleaning device 5 is constructed as a twin-steam device; and exhaust-gas manifold 1 collects the exhaust gas from cylinders 1 and 4 in one partial stream and the exhaust gas from cylinders 2 and 3 in another partial stream, each partial stream being fed to a separate branch of exhaust-gas cleaning device 5. For this purpose, tubular section 12 is constructed as a two-stream double funnel 16 with spectacle-shaped cross section. Corresponding to the embodiment illustrated in FIG. 3, the end of double funnel 16 allocated to exhaust-gas manifold 1 is cast into the end regions of outlets 4 of exhaust-gas manifold 1. The opposite end region of double funnel 16 is welded to jacket 8 of the housing of the exhaust-gas cleaning device.

We claim:

1. An exhaust-gas collecting and cleaning device for a multi-cylinder engine, comprising an exhaust-gas manifold (1) constructed as a casting and an exhaust-gas cleaning device (5) mounted near the engine, attached to the exhaust-gas manifold (1) and comprising a housing (6) and at least one exhaust-gas cleaning element (14) bedded therein, characterized in that a tubular section (12), which is constructed as a sheet-metal part and projects from the casting, and to which a downstream segment of the housing (6) of the exhaust-gas cleaning device (5) is joined, is cast into the exhaust-gas manifold (1) at the outlet end region thereof.

2. An exhaust-gas collecting and cleaning device according to claim 1, characterized in that the tubular section cast (12) into the exhaust-gas manifold (1) is constructed as the inlet funnel (7) of the housing (6) of the exhaust-gas cleaning device (5).

3. An exhaust-gas collecting and cleaning device according to claim 1, characterized in that the tubular section (12) is formed as the connecting pipe (11) to which the inlet funnel (7) of the housing (6) of the exhaust-gas cleaning device (5) is joined.

4. An exhaust-gas collecting and cleaning device according to one of claims 1, characterized in that the tubular section (12) and the downstream segment of the housing (6) of the exhaust-gas cleaning device (5) are joined to each other by means of a weld (13).

5. An exhaust-gas collecting and cleaning device according to claim 4, characterized in that the tubular section (12) comprises easily weldable sheet metal.

6. An exhaust-gas collecting and cleaning device according to one of claims 1, characterized in that the wall thicknesses of the tubular section (12) and of the downstream segment of the housing (6) of the exhaust-gas cleaning device (5) are substantially the same.

7. An exhaust gas device for a multi-cylinder engine, comprising an exhaust-gas manifold constructed as a casting and an exhaust-gas guide element mounted near the engine, characterized in that a tubular section, which is constructed as a sheet metal part and projects from the casting, and which is part of the downstream exhaust-gas guide element or is joined thereto, is cast into the exhaust-gas manifold at the outlet end region thereof.

* * * * *

UNITED STATES PATENT AND TRADEMARK OFFICE

CERTIFICATE OF CORRECTION

PATENT NO. : 5,911,683

DATED : June 15, 1999

INVENTOR(S) : Hongjiang CUI, et al.

It is certified that error appears in the above-indentified patent and that said Letters Patent is hereby corrected as shown below:

Drawings:

Please delete sheets two and three of the drawings which are incorrect and insert the enclosed corrected drawings for sheets two and three.

Signed and Sealed this

Seventh Day of March, 2000

*Attest:*

*Attesting Officer*

Q. TODD DICKINSON

*Commissioner of Patents and Trademarks*